US007743922B2

(12) United States Patent
Pitt

(10) Patent No.: US 7,743,922 B2
(45) Date of Patent: Jun. 29, 2010

(54) PACKAGING

(75) Inventor: Jeffrey Graham Pitt, Fowey (GB)

(73) Assignee: Protective Packaging Systems Limited, Cornwall (GB)

( * ) Notice: Subject to any disclaimer, the term of this patent is extended or adjusted under 35 U.S.C. 154(b) by 420 days.

(21) Appl. No.: 11/628,175

(22) PCT Filed: May 26, 2005

(86) PCT No.: PCT/GB2005/002089

§ 371 (c)(1),
(2), (4) Date: Nov. 30, 2006

(87) PCT Pub. No.: WO2005/118423

PCT Pub. Date: Dec. 15, 2005

(65) Prior Publication Data

US 2008/0067105 A1 Mar. 20, 2008

(30) Foreign Application Priority Data

Jun. 1, 2004 (GB) ..... 0412173.7

(51) Int. Cl.
*B65D 81/02* (2006.01)
*B65D 85/30* (2006.01)
*B65D 85/00* (2006.01)

(52) U.S. Cl. ..... 206/521; 206/585; 206/701

(58) Field of Classification Search ..... 206/701, 206/722, 723, 521, 523, 585, 591, 592, 525, 206/525.1, 747, 748; 220/4.21, 4.22, 4.23, 220/4.24, 4.25, 4.29
See application file for complete search history.

(56) References Cited

U.S. PATENT DOCUMENTS 2,555,473 A * 6/1951 Deaton ..... 220/4.23
3,052,347 A * 9/1962 Whiteford ..... 206/422
3,103,278 A * 9/1963 Kuzma et al. ..... 206/433
3,136,413 A * 6/1964 Hall ..... 206/305

(Continued)

FOREIGN PATENT DOCUMENTS

GB 2 107 284 4/1983

(Continued)

*Primary Examiner*—Ehud Gartenberg
*Assistant Examiner*—Dene Quest
(74) *Attorney, Agent, or Firm*—Davis & Bujold, P.L.L.C.

(57) ABSTRACT

A packaging case (C;C') erected by folding from a one-piece vacuum-formed molded sheet, has rectangular walls (1-4;71-74) that fold, and are clipped closed, about an article (A;S) to be protected from shock. The ends of the case are almost-completely closed by conformal edge-to-edge abutment of end-flanges (8-11;78-81) of serpentine profile that are upstanding from the walls (1-4;71-74). The flange-edges are each molded with ridges (13, 15) and grooves (14, 16) that nest ridge-within-groove with those of the abutting edges, for absorbing shock. The walls (1-4;71-74) are hinged together edge-to-edge, and at their edges rise in steps (23,24,33.34,43, 44) to a central plinth (22,32,42). The steps (23,24,33,34,43, 44) of adjacent walls abut one another within the erected case for shock absorption, and each wall (1-4;71-74) is strengthened by circular recesses (25-28,35-38,45-49) of reducing diameter with depth, let into its plinth (22,32.42). The circular recesses produce frusto-conical shock-absorbing projections (57,58,60,62,63) on the outside of the case. The case (C') may accommodate a stack (S) of component-carrying trays (T) protected by end-caps (83).

18 Claims, 6 Drawing Sheets

U.S. PATENT DOCUMENTS

| | | | | | |
|---|---|---|---|---|---|
| 3,192,978 | A | * | 7/1965 | William-Horvath | 206/592 |
| 3,853,221 | A | * | 12/1974 | Boyd | 206/523 |
| 3,901,406 | A | * | 8/1975 | Kivett | 220/8 |
| 3,987,956 | A | * | 10/1976 | Congleton | 229/120.07 |
| 3,992,810 | A | * | 11/1976 | Kimball | 47/77 |
| 4,114,761 | A | * | 9/1978 | Kleiner | 206/591 |
| 4,466,552 | A | * | 8/1984 | Butterworth et al. | 220/798 |
| 4,471,573 | A | * | 9/1984 | Voges | 47/84 |
| 5,388,714 | A | * | 2/1995 | Zutler | 220/4.24 |
| 5,551,568 | A | | 9/1996 | Niles et al. | |
| 5,577,614 | A | | 11/1996 | Palmeroni et al. | |
| 5,678,692 | A | * | 10/1997 | Gratz | 206/453 |
| 5,806,683 | A | | 9/1998 | Gale | |
| 6,010,007 | A | * | 1/2000 | Moren et al. | 206/587 |
| 6,029,803 | A | * | 2/2000 | Ovadia et al. | 206/6.1 |
| 6,082,546 | A | * | 7/2000 | Liao et al. | 206/592 |
| 6,142,304 | A | * | 11/2000 | Moren et al. | 206/587 |
| 6,206,217 | B1 | * | 3/2001 | Chiang | 220/8 |
| 6,695,140 | B2 | * | 2/2004 | Manuel | 206/320 |
| 7,216,763 | B2 | * | 5/2007 | Gormick et al. | 206/320 |
| 2004/0056030 | A1 | * | 3/2004 | Coppedge et al. | 220/4.23 |
| 2006/0096822 | A1 | * | 5/2006 | Gormick et al. | 190/125 |

FOREIGN PATENT DOCUMENTS

| | | |
|---|---|---|
| GB | 2 187 439 | 9/1987 |
| GB | 2 279 334 | 1/1995 |
| GB | 2 313 586 | 12/1997 |

* cited by examiner

PACKAGING

This application is a national stage completion of PCT/GB2005/002089 filed May 26, 2005 which claims priority from British Application Serial No. 0412173.7 filed Jun. 1, 2004.

FIELD OF THE INVENTION

This invention relates to packaging and is concerned particularly with packaging for use in protecting articles against damage and shock during storage and transit.

BACKGROUND OF THE INVENTION

Various packaging methods have been used for protecting, for example electronic components, during storage and transit. These methods, in addition to being generally labour-intensive, commonly involve a substantial outlay in cost and material-resources on packaging items in the form, for example, of cardboard cases and specially-designed items of plastics foam and corrugated cardboard to fit within them.

SUMMARY OF THE INVENTION

It is one of the objects of the present invention to provide a form of packaging case that may be used with advantage in the protection of articles against damage and shock, and for reducing outlay in cost and material-resources.

According to the present invention there is provided a packaging case for enclosing one or more articles to protect them against damage and shock during storage and transit, wherein the case has walls which are of sheet material with recesses therein for strengthening and which are for edge-to-edge abutment one with another, and wherein the abutting edges of the walls are each formed with ridges and grooves that nest with one another ridge-within-groove when in mutual abutment.

It has been found that the ridge-within groove nesting at abutting edges of the packaging case of the present invention is very effective for resisting and cushioning shock, and is a feature that enables enhanced packaging to be provided economically.

The packaging case of the invention may be of moulded-sheet construction, and may be moulded in one piece. Furthermore, and with advantage for storage before use and ease of bringing into use, the case may be adapted to be erected from a flat form, simply by folding. In the latter regard, the walls may be hinged one to another to facilitate erection. The hinges may be along edges of the walls which abut one another in the erected case and which are stepped to provide mutual ridge-within-groove nesting lengthwise of those edges.

The walls of the case may have flanges that abut one another edge-to-edge, and the abutting edges of these flanges may each be formed with ridges and grooves to nest with one another ridge-within-groove when they are in mutual abutment. In particular, where the walls of the case are rectangular and are hinged longitudinally to one another for erection of the case from a flat form, the flanges may be upstanding from ends of the walls so as to be brought into edge-to-edge abutment one with another on erection of the case. The flanges may be of serpentine profile, and in this event, the edge-to-edge abutment between one flange and another may be between flanges of substantially conformal, double- and single-hump serpentine profile respectively.

The recesses in the walls of the case may comprise recesses of circular configuration, and these may each be of a tiered form having a diameter that decreases with depth. Where the case is of moulded-sheet construction with the circular recesses inside the case, they may provide stepped, shock-cushioning projections on the outside of the case.

BRIEF DESCRIPTION OF THE DRAWINGS

A packaging case in accordance with the present invention will now be described, by way of example, with reference to the accompanying drawing, in which.

DETAILED DESCRIPTION OF THE INVENTION

Figure 1:
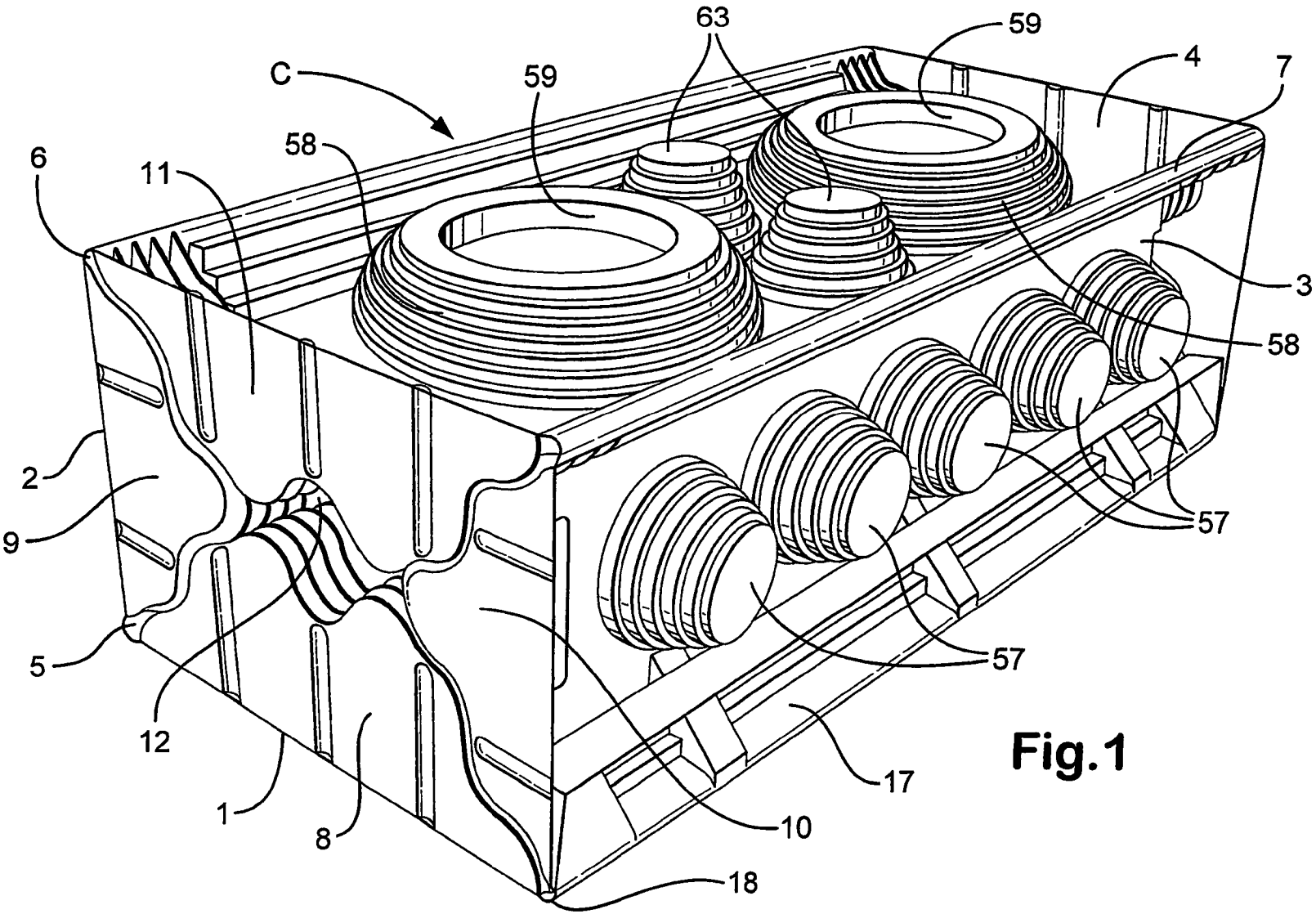
FIG. 1 is a perspective view of the packaging case in accordance with the invention.
Figure 2:
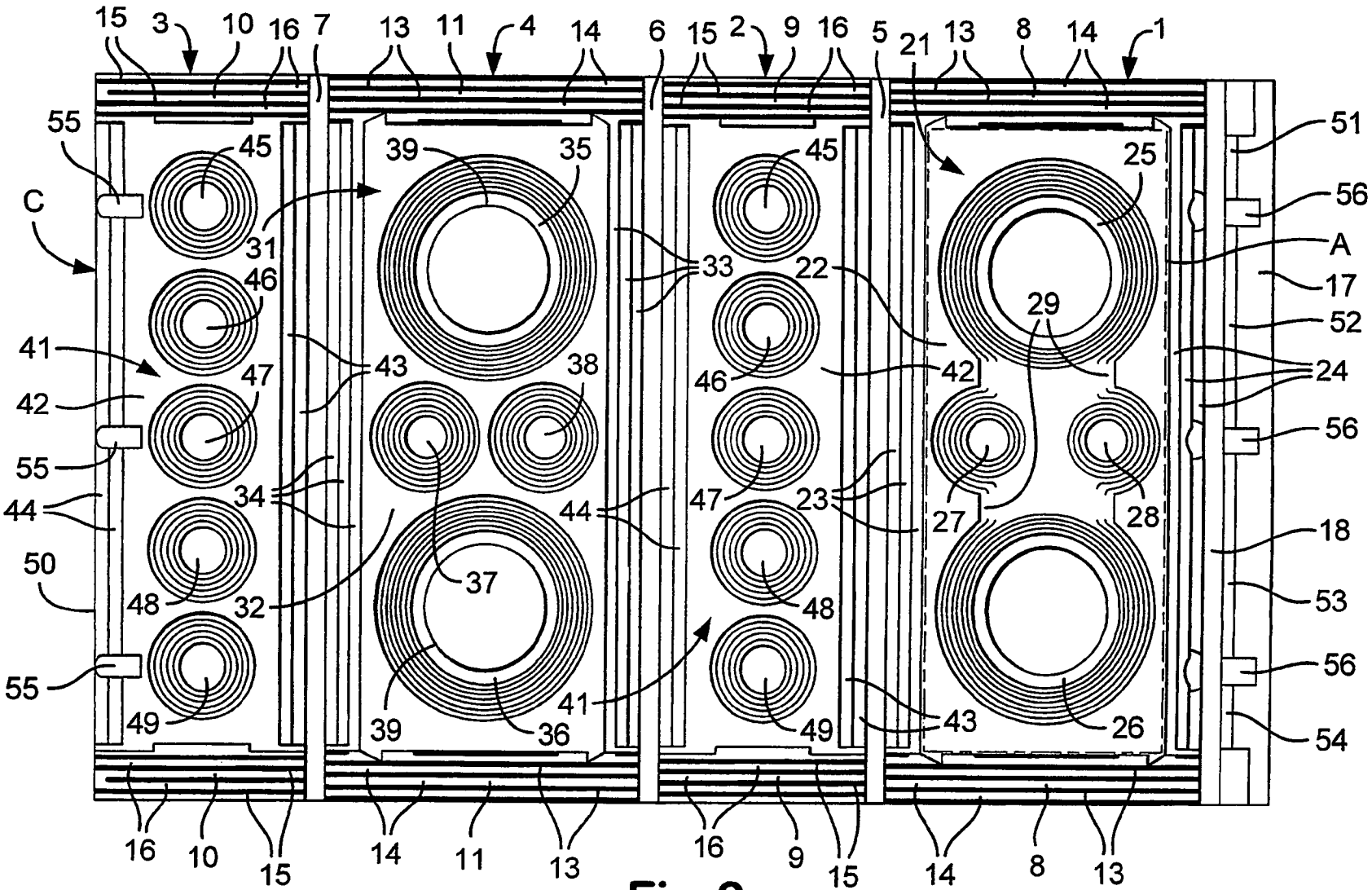
FIG. 2 is a plan view of a one-piece, moulded sheet from which the packaging case of FIG. 1 is erected by folding.

Referring to FIG. 1, the packaging in this example takes the form of a rectangular case C for enclosing an article to be protected. The case C is erected from a one-piece vacuum-formed moulded sheet of thermoplastic material (for example, of polypropylene), which is shown in FIG. 2 in flat form, and which has four substantially rectangular walls, namely, a base-wall 1, side-walls 2 and 3 and a top-wall 4, that are hinged one to another longitudinally. More particularly, the side-wall 2 is hinged to the base-wall 1 by an integral hinge 5, and the top-wall 4 is hinged to the side-walls 2 and 3 by integral hinges 6 and 7 respectively, so as to allow the case to be erected from the flat form shown in FIG. 2, into the form shown in FIG. 1.

Figure 3:
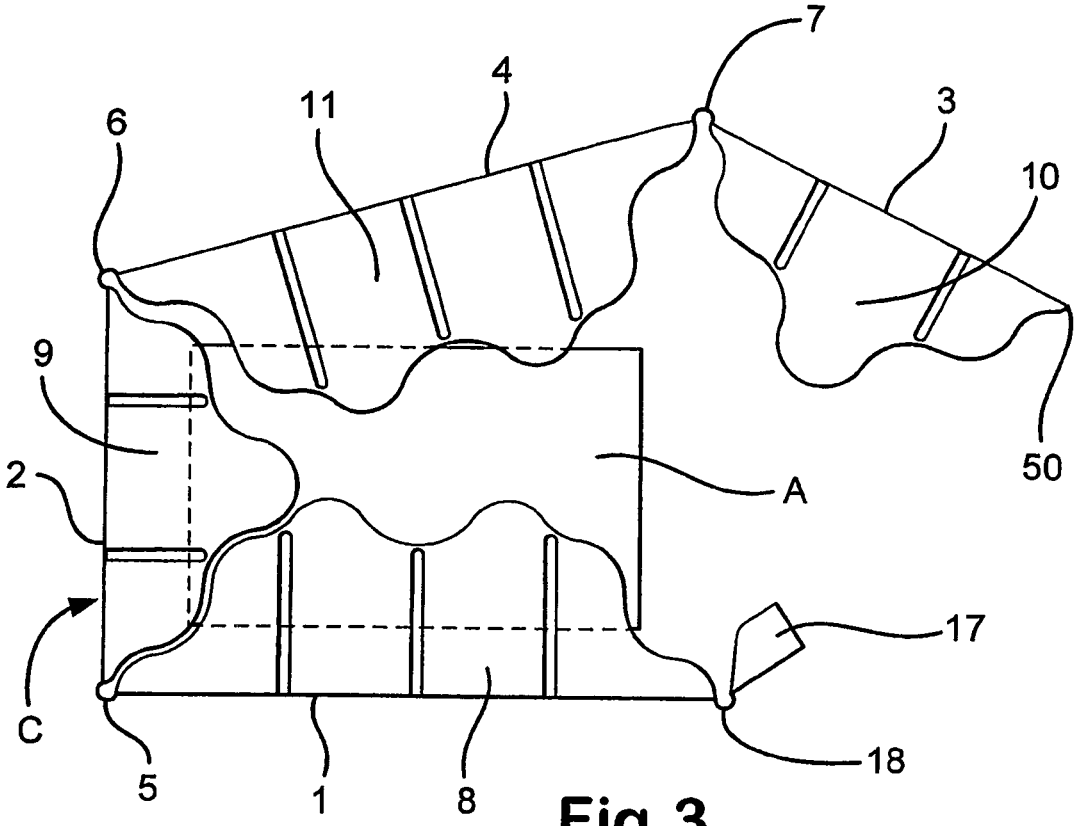
FIG. 3 is illustrative of a stage during erection of the packaging case of FIG. 1 from the one-piece sheet of FIG. 2.

Erection of the case C is carried out with the article A to be protected (represented in chain-dotted outline in FIG. 2), standing on the base-wall 1, and folding the walls 2 to 4 round it, as illustrated in an intermediate state by FIG. 3. More particularly, with the article A supported horizontally on the base-wall 1, the side-wall 2 is folded upwardly on the hinge 5 allowing the top-wall 4 to be folded down on the hinge 6 horizontally over the article A and the side-wall 3 to be folded downwardly on the hinge 7 to engage the base-wall 1 and thereby complete enclosure of the article A.

Figure 4:
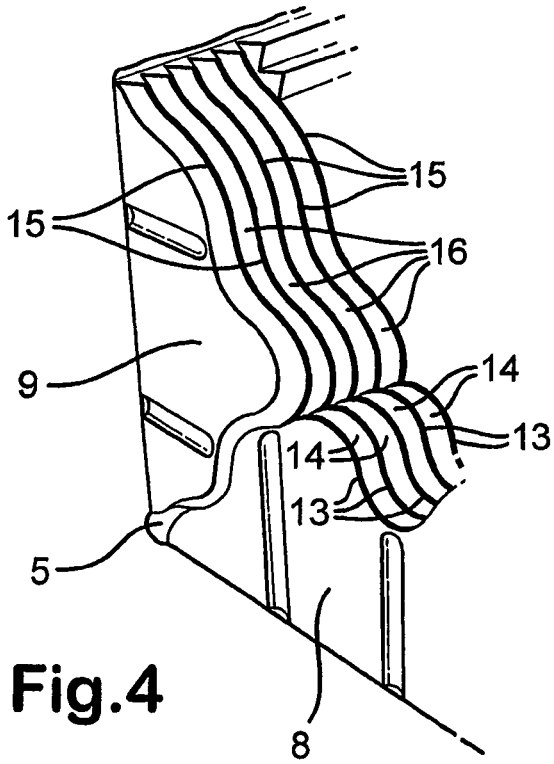
FIG. 4 is a perspective view showing detail of abutting flanges of the packaging case of FIG. 1.

The walls 1 to 4 have upstanding flanges 8 to 11 respectively, at each end of the case C; the outside faces of the flanges 8 to 11 are grooved for enhanced rigidity. The flanges 8 to 11 at each end come into conformal edge-to-edge abutment with one another when the case C is erected, and this is effective to close the end of the case except for a small central aperture 12 that enables the presence of the article A to be readily checked visually. The flanges 8 and 11 of the walls 1 and 4 are of a double-hump serpentine profile (to be seen in FIGS. 1 and 3) and have ridges 13 with intervening, grooves 14 running along their edges, whereas the flanges 9 and 10 of the side-walls 2 and 3 are of a single-hump serpentine profile (FIGS. 1 and 3) and have ridges 15 with intervening grooves 16 running along their edges. The ridges 13 nest within the grooves 16, and the ridges 15 nest within the grooves 14 when the walls 1 to 4 are folded up together in the erect case C. The ridge-within-groove nesting between the abutting edges of the flanges 8 and 9 is illustrated in FIG. 4.

The case C is clipped closed in the erect condition by means of a flap 17 which is integral through a hinge 18 with the base-wall 1. The flap 17 engages resiliently with the side-wall 3 to clip the side-wall 3 to the base-wall 1 and thereby lock the case C in its erect condition folded round the article A.

Referring more particularly to FIG. 2, the inside surface 21 of the base-wall 1 has a central, rectangular plinth-area 22 that rises up through steps 23 and 24 from the hinges 5 and 18 respectively, along the two longitudinal edges of the wall 1. The end-flanges 8 rise above the area 22, and two large, circular recesses 25 and 26 together with two smaller, circular recesses 27 and 28, are let into the area 22. Each of the recesses 25 to 28 is of a tiered form having a progressively decreasing diameter with depth to provide cushioning against shock. They also add to the strengthening of the sheet-form wall 1 provided by the steps 23 and 24.

A shallow recess 29 is let into the plinth-area 22 partly breaking into the recesses 25 to 28. The purpose of this is to accommodate a sachet (not shown) of silica gel or other desiccant, under the article A. As an alternative, the recess 29 may be used to accommodate literature associated with article A.

The top-wall 4 is configured in substantially the same way as the base-wall 1, but without a recess corresponding to the recess 29. In particular, the inside surface 31 of the wall 4 has a central, rectangular plinth-area 32 that rises up through steps 33 and 34 from the hinges 6 and 7 respectively, along the two longitudinal edges of the wall 4. The end-flanges 11 rise above the area 32, and two large, circular recesses 35 and 36 together with two smaller, circular recesses 37 and 38 are let into the area 32. Each of the recesses 35 to 38 is of a tiered form having a progressively decreasing diameter with depth, so as to provide cushioning against shock and add to the strengthening of the sheet-form wall 4 provided by the steps 33 and 34. However, and in distinction to the recesses 25 and 26 of the wall 1, each recess 35 and 36 has a central, raised portion 39 (to the height of the bottom two tiers only).

The two side-walls 2 and 3 are of essentially the same configuration as one another. In particular, the inside surface 41 of each wall 2 and 3 has a central, rectangular plinth-area 42 that rises up through steps 43 and 44 from the two longitudinal edges of the respective wall 2 and 3. The end-flanges 9 and 10 rise above the respective areas 42, and five small, circular recesses 45 to 49 are let into each area 42. Each recess 45 to 49 is of a tiered form having a progressively decreasing diameter with depth so as to provide cushioning against shock and add to the strengthening of the sheet-form walls 2 and 3 provided by the steps 43 and 44.

When the case C is erect, the steps 43 and 44 abut respectively the steps 23 of the base-side 1 and the steps 33 of the top-wall 4; the abutment in each case is effective to nest the ridges of the steps 43 and 44 within the grooves of the steps 23 and 33. Similarly, the steps 43 and 44 abut respectively the steps 34 of the top-wall 4 and the steps 24 of the base-wall 1, effectively nesting the ridges of the steps 43 and 44 within the grooves of the steps 34 and 24. This nesting, together with the nesting of the ridges 15 of the flanges 9 and 10 in the grooves 14 of the flanges 8 and 11, and the ridges 13 of the flanges 8 and 11 in the grooves 16 of the flanges 9 and 10, gives a degree of rigidity to the case C enclosing the article A.

The free-edge 50 of the side-wall 3 projects into the fold of the hinge 18 and the flap 17 is turned over onto the outside of the wall 3 to bring steps 51 to 54 of the flap 17 into abutment with the reverse faces of the steps 44. The steps 44 are broken into by three channels 55 that correspond to channels 56 that divide the steps 51 to 54 from one another, and these channels 56 engage resiliently over the reverse faces of the channels 55 on the outside of the wall 3, in the locking of the wall 3 to the wall 1.

Additional or alternative means may be provided for retaining or locking the case closed. For example, studs may be moulded into the flap 17 for push-fit retention within apertures in the channels 56, or the flap 17 may be welded closed.

Figure 5:
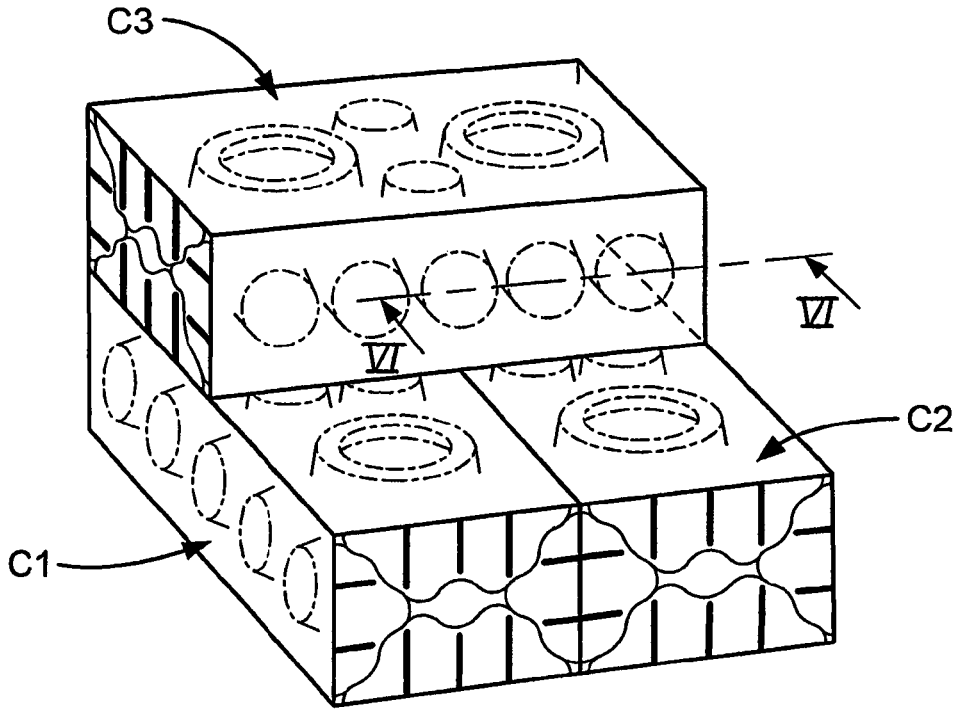
FIG. 5 is illustrative of an initial stage in stacking packaging cases having the form shown in FIG. 1.

Cases having the form of case C described above, can be stacked one upon the other to provide a coherent stack that is advantageous for storage and transportation. FIG. 5 is illustrative of an initial stage involving just three cases C1 to C3, in the building of an example of such a stack.

Referring to FIG. 5, the cases C1 and C2 are located side by side and the case C3 is set transversely on top of them. The side-walls 3 and 2 of the cases C1 and C2 respectively, lie against one another (in the orientation illustrated) with the stepped, frusto-conical projections 57 (FIG. 1) that are formed on the outside of each such wall by the reverses of the recesses 45 to 49, abutting one another to absorb lateral shock. The cases C1 and C2 are held together in this abutment by interlocking of the base-wall 1 of the case C3 with the top-wall 4 of each underlying case C1 and C2. This interlocking results from the moulding of the recesses 35 and 36 in the top-wall 4 of the cases C1 and C2, and of the recesses 25 and 28 in the base-wall 1 of the case C3 (FIG. 2).

Figure 6:
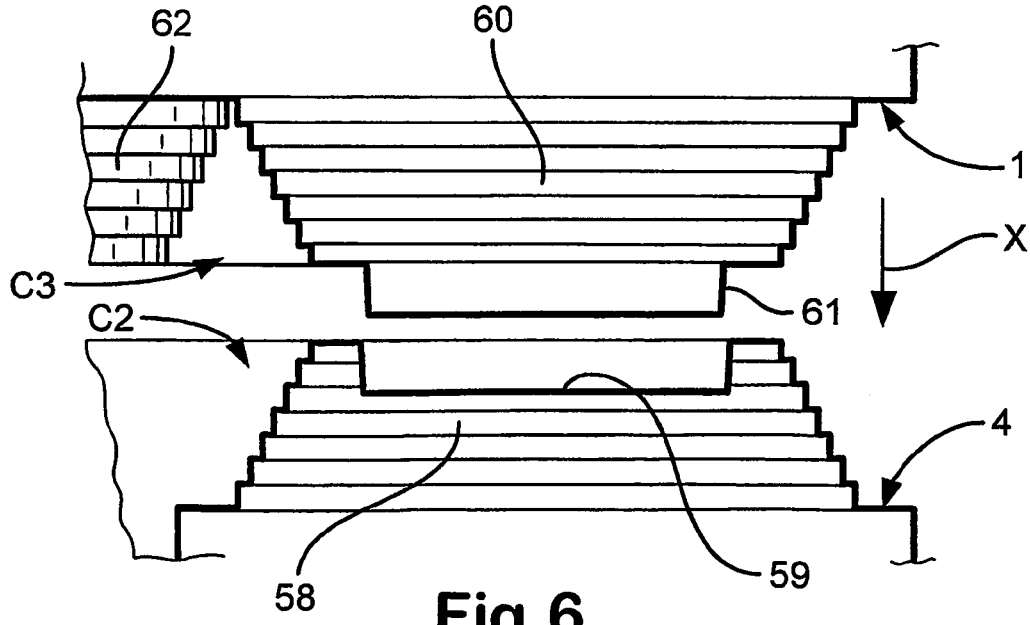
FIG. 6 is a representative section taken on the line VI-VI of FIG. 5.

More particularly, as illustrated in FIG. 6, the reverse of each recess 35 and 36 creates a stepped, frusto-conical projection 58 on the outside of the top-wall 4 with a socket 59 as the reverse of the raised portion 39. A stepped, frusto-conical projection 60 is similarly created on the outside of the base-wall 1 by the reverse of each recess 25 and 28, but in this instance with a top 61 that is a push fit (indicated by the arrow X in FIG. 6) within the socket 59. When the top 61 of the projection 60 is pushed fully home in the socket 59, the stepped frusto-conical projections 62 that are created on the outside of the base-wall 1 by the reverse of the recesses 27 and 28, abut the hinges 6 and 7 of the underlying cases C1 and C2. The corresponding projections 63 (FIG. 1) created on the outside of the top-wall 4 of each case C1 and C2 by the reverse of the recesses 37 and 38, abut the hinge 18 of the case C3.

The remainder of the stack is built up with a case (not shown) set alongside the case C3, and with further cases stacked correspondingly with the successive levels set transversely to one another so as to afford a measure of bonding for enhanced rigidity of the stack. In addition to there being absorption of lateral shock in the stack through abutment of the stepped, frusto-conical projections 57 of adjacent cases with one another, there is also absorption of vertical shock through abutment principally of the stepped, frusto-conical projections 60 of each case with the stepped, frusto-conical projections 58 of the underlying ones.

The interlocking of cases C with one another and resilient cushioning of shock between them, applies also when an overlying case is aligned with an underlying one. In these circumstances, however, push-fit of the tops 61 of the projections 60 of the overlying case C within the sockets 59 of the two projections 58 of the underlying case C, brings the projection 62 of the overlying case C into abutment with respective ones of the projections 63 of the underlying case C.

The stepped form of the frusto-conical projections 57, 58, 60, 62 and 63 gives each case C a degree of resilient cushioning for resisting shock that might otherwise damage the enclosed article A or the case C itself. The protection afforded is especially effective against components of shock at right angles to the walls 1 to 4 and is augmented by the resilient cushioning of the plinth-areas 22, 32 and 42 of the walls 1 to 4 that results from the steps 23, 24, 33, 34, 43 and 44. However, the nesting abutment of the steps 43 and 44 with the steps 23 and 33, and with the steps 34 and 24, results in resistance also to shock components at other angles to the walls 1 to 4 and on the hinges 5 to 7 and 18. All this is in addition to the resilient cushioning that results from the bellows-like structure provided by the ridge-and-groove moulding of the edges of the flanges 8 to 11 at either end of the case. The ridges 13 and 15 are moulded with rounded (as opposed to pointed) tops and the grooves 14 and 16 with correspondingly-rounded bottoms, so that the edge of each flange 8 to 11 has compressibility with strong restorative resilience for resisting shock acting longitudinally of the case C. Moreover, the serpentine profiles of the flanges 8 to 11 reduce the likelihood of shocks being transmitted along the abutment interfaces between them.

Small holes may be drilled into the bottoms of the grooves 14 and 16 adjacent the hinges 5, 6, 7 and 18 and the free-edge 50. These holes stiffen the abutting edges of the flanges 8 to 11 and increase the damping effect of shock absorption. Furthermore, each of the hinges 5, 6, 7 and 18 may be grooved along its full length, or at least for a short distance from its ends, for stiffening purposes. The existence of the grooving, certainly at the ends, of the hinges, can be of advantage in providing enhanced resistance and cushioning against shock applied to any of the eight corners of the case.

A modified form of the case C is illustrated and will now be described with reference to FIGS. 7 to 9.

Figure 7:
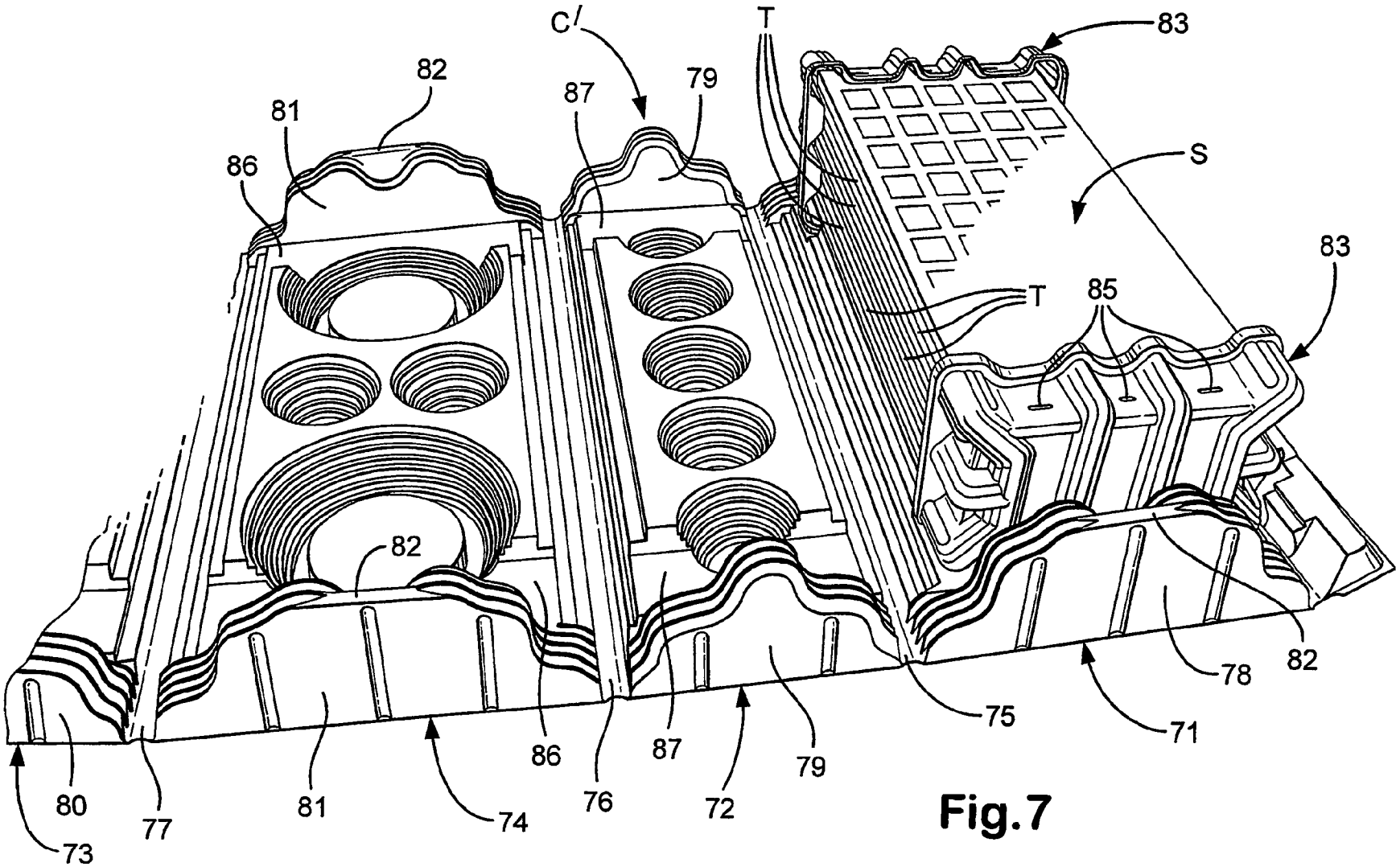
FIG. 7 is illustrative of a modified form of the packaging case of FIG. 1, prior to erection, and showing a stack of component-carrying trays with end-caps, to be contained by the modified case.
Figure 8:
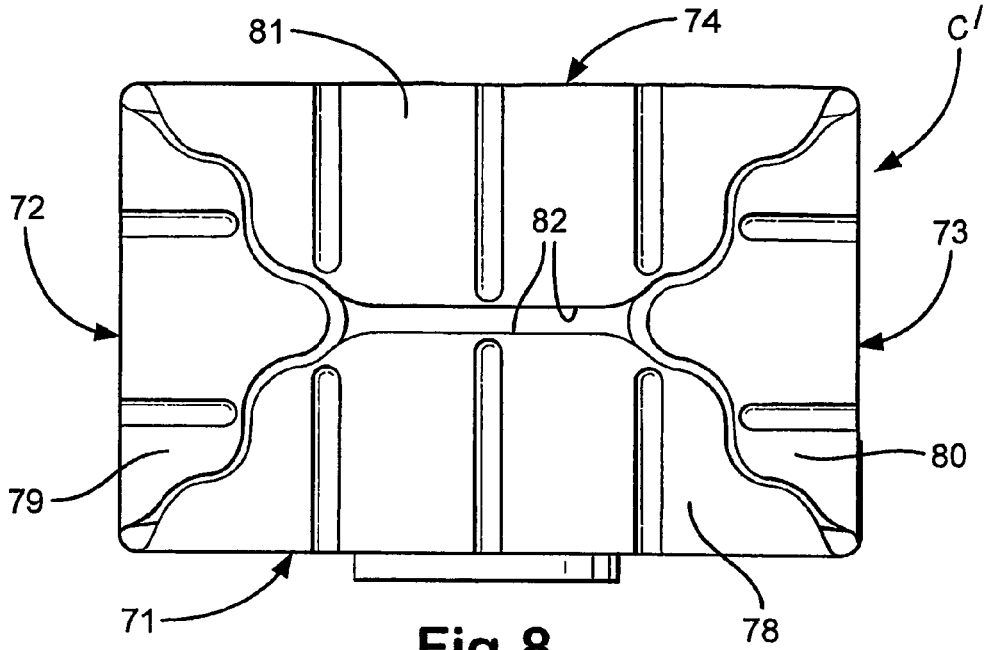
FIG. 8 is an end-elevation of the modified packaging case of FIG. 7 when erected.

Referring initially to FIGS. 7 and 8, the modified case C' like the case C, is formed as a one-piece vacuum-formed thermoplastic sheet having a base-wall 71, two side-walls 72 and 73 (the side-wall 73 is broken away in FIG. 7) and a top-wall 74. These walls 71 to 74 correspond respectively to the walls 1 to 4 of the case C, and are hinged together by hinges 75 to 77 corresponding to the hinges 5 to 7 respectively of the case C.

The walls 71 to 74 have upstanding end-flanges 78 to 81 with inter-nesting ridged-and-grooved edges of single- and double-hump serpentine profile in essentially the same manner as the flanges 8 to 11 of the case C. However, in the case C', the outer faces 82 of the flanges 78 and 81 are straightened from the double-hump form, so that there is no aperture corresponding to the aperture 12 in either end of the erect case C' (see FIG. 8).

The case C' is specially adapted for the packaging of rectangular trays T which carry electronic chips and cards. The trays T are carried by the case C' in a stack S with the individual trays T held in place one upon the other by packaging caps 83 at either end of the stack S.

Figure 9:
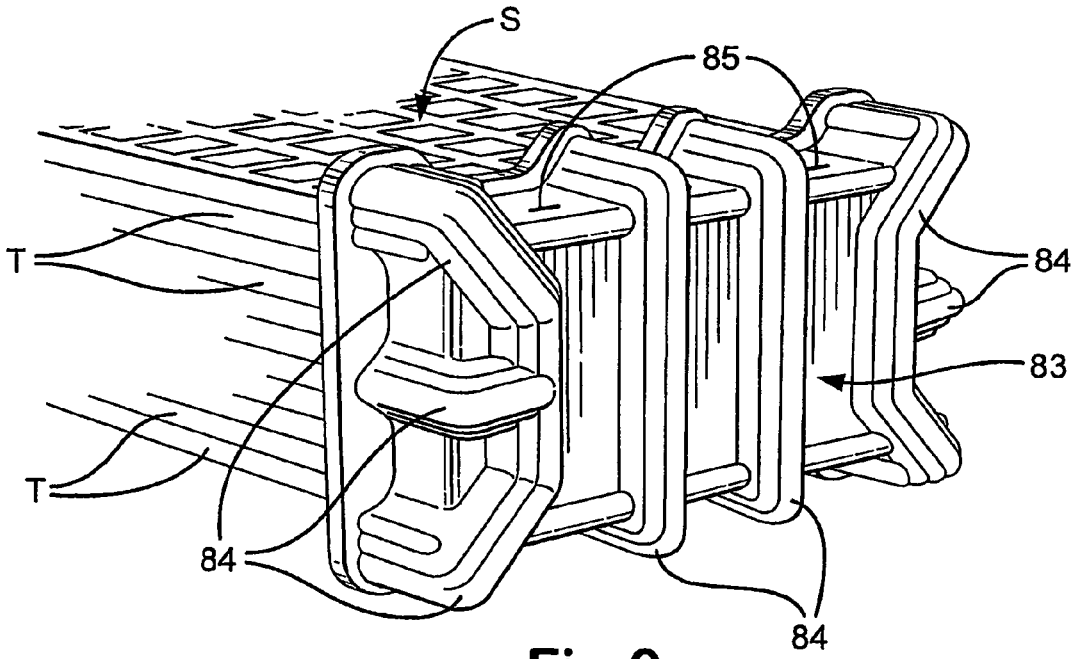
FIG. 9 is a perspective view of one end of the stack of component-carrying trays shown in FIG. 7, illustrating detail of one of the end-caps used in the packaging of the stack.

Referring now also to FIG. 9, each packaging end-cap 83, which is a one-piece vacuum-formed moulded sheet of thermoplastic material (for example, of polypropylene), is of a rectangular U-section to enable it to be fitted onto, so as to enclose, the end of the stack S. It is formed with strengthening ribs 84 that are of a stepped profile made up of rounded steps so as to provide resilient cushioning for protection of the stack-end. The resilience of the cushioning ribs 84 allows the cap 83 to be stretched for fitting onto the end of the stack S and to be retained there resiliently.

Each end-cap 83 has indents 85 that in the reverse (on the inside of the cap 83) provide projections which engage resiliently with respective alignment slots in the trays T for enhancing retention of the cap 83 on the end of the stack S. Furthermore, the spacings between the ribs 84 allow two or three straps (not shown) to be used to bind the caps 83 and trays T together longitudinally as one.

The stack S fitted with its end-caps 83 will normally be sealed within an anti-static bag together with a desiccant pack; the desiccant pack will be positioned within the bag to rest in any specially-provided recess corresponding to the recess 29 of the case C. Because of the internal stepped and recessed form of the moulding, there will be space for air-movement within the bag to enable the desiccant to be effective.

The case C' incorporates recesses 86 let into both ends of each wall 71 and 74, and recesses 87 let into both ends of each wall 72 and 73, to accommodate the end-caps 83. Undercuts against the flanges 78 to 81 at both ends of each wall 71 to 74 may be provided to ensure that the corners of the stack S within the end-caps 83 float.

The invention claimed is:

1. A packaging case for enclosing one or more articles to protect the one or more articles against damage and shock during storage and transit, wherein the case has walls which are of sheet material, the walls have recesses therein to strengthen the walls, and the walls have pairs of mutually-abutting edges that abut one another edge-to-edge, and each abutting edge of each individual pair of abutting edges has both ridges and intervening grooves that run along the edge side-by-side with one another, and wherein the abutting edges of each individual pair of abutting edges abut one another with mutual ridge-within-groove nesting between the ridges and intervening grooves of the respective abutting edges of the pair when those edges are in mutual abutment.

2. The packaging case according to claim 1, wherein the case is of molded-sheet construction.

3. The packaging case according to claim 2, wherein the case is of one-piece molded sheet.

4. The packaging case according to claim 3, wherein the case is erected from a flat form, by folding.

5. The packaging case according to claim 4, wherein the walls are hinged one to another to enable erection of the case.

6. The packaging case according to claim 1, wherein at least some of the pairs of abutting edges are abutting edges of walls which are hinged together along those edges.

7. The packaging case of claim 6, wherein the abutting edges of walls which are hinged together along those edges are of a stepped configuration to provide mutual ridge-within-groove nesting along those edges.

8. The packaging case according to claim 1, wherein the walls have flanges that abut one another edge-to-edge, and the abutting edges of the flanges are each formed with ridges and grooves to nest with one another ridge-within-groove when in mutual abutment.

9. The packaging case according to claim 1, wherein the recesses in the walls comprise recesses of circular configuration.

10. The packaging case according to claim 9, wherein the circular recesses are each of a tiered form having a diameter that decreases with depth.

11. The packaging case according to claim 10, wherein the case is of molded-sheet construction and the circular recesses are inside the case to provide stepped, shock-cushioning projections on an outside of the case.

12. A packaging case of molded-sheet construction for enclosing one or more articles to protect them against damage and shock during storage and transit, wherein the case has rectangular walls of sheet material molded with recesses for strengthening the walls, the walls are hinged together for erection of the packaging case from a flat condition to an erect condition, each wall has two longitudinal edges each of which abuts a respective one of the two longitudinal edges of another of the walls in the erect condition of the packaging case to form abutting pairs of edges between the walls in the erect condition of the packaging case, and the walls have upstanding end-flanges each of which has an elongate edge that abuts the elongate edge of another of the flanges in the erect condition of the packaging case to form abutting pairs of edges between the flanges in the erect condition of the packaging case, and wherein each abutting edge of each individual pair of abutting edges of the walls and of each individual pair of abutting edges of the flanges has both ridges and grooves running along the edge for ridge-to-groove nesting with the grooves and ridges respectively of the other abutting edge of the respective pair for strengthening the packaging case in its erect condition.

13. The packaging case according to claim 12, wherein the flanges are of serpentine profile.

14. A packaging case for enclosing one or more articles to protect the one or more articles against damage and shock during storage and transit, wherein the case has walls which are of sheet material, the walls have recesses therein for strengthening the walls, and the walls have pairs of abutting edges for edge-to-edge abutment of the two abutting edges of each pair with one another, and each abutting edge of each individual pair of abutting edges has both ridges and grooves for ridge-within-groove nesting with the grooves and ridges respectively of the other abutting edge of the pair when those edges are in mutual abutment, the walls have flanges that abut one another edge-to-edge, and the abutting edges of the flanges are each formed with ridges and grooves to nest with one another ridge-within-groove when in mutual abutment, and wherein the walls are rectangular and are hinged longitudinally to one another for erection of the case from a flat form, and the flanges are upstanding from ends of the walls to be brought into edge-to-edge abutment one with another on erection of the case.

15. The packaging case according to claim 14, wherein the flanges are of a serpentine profile.

16. A packaging case for enclosing one or more articles to protect the one or more articles against damage and shock during storage and transit, wherein the case has walls which are of sheet material, the walls have recesses therein for strengthening the walls, and the walls have pairs of abutting edges for edge-to-edge abutment of the two abutting edges of each pair with one another, and each abutting edge of each individual pair of abutting edges has both ridges and grooves for ridge-within-groove nesting with the grooves and ridges respectively of the other abutting edge of the pair when those edges are in mutual abutment, wherein the walls have flanges that abut one another edge-to-edge, and the abutting edges of the flanges are each formed with ridges and grooves to nest with one another ridge-within-groove when in mutual abutment, and wherein the walls are rectangular and are hinged longitudinally to one another for erection of the case from a flat form, the flanges are upstanding from ends of the walls to be brought into edge-to-edge abutment one with another in pairs on erection of the case, and the edge-to-edge abutment between one flange and another of each pair of flanges is between edges of double-hump and single-hump serpentine profile respectively for nesting comformably with one another when in mutual edge-to-edge abutment.

17. A packaging case for enclosing one or more articles to protect the one or more articles against damage and shock during storage and transit, wherein the packaging case is in combination with end-caps for engaging respective ends of an article to be enclosed within the case, the case has walls which are of sheet material, the walls have recesses therein for strengthening the walls, and the walls have pairs of abutting edges for edge-to edge abutment of the two abutting edges of each pair with one another, and each abutting edge of each individual pair of abutting edges has both ridges and grooves for ridge-within-groove nesting with the grooves and ridges respectively of the other abutting edge of the pair when those edges are in mutual abutment.

18. The packaging case according to claim 17, wherein recesses are provided in the walls of the case to accommodate the end-caps when engaged with the respective ends of the article.

* * * * *